US010011964B2

(12) United States Patent
De Vries

(10) Patent No.: US 10,011,964 B2
(45) Date of Patent: Jul. 3, 2018

(54) METHOD FOR FORMING A GROUND-COVERING LAYER, AND THUS FORMED GROUND-COVERING LAYER

(75) Inventor: Hugo De Vries, Ridderkerk (NL)

(73) Assignee: Greenfields B.V., Nijverdal (NL)

( * ) Notice: Subject to any disclaimer, the term of this patent is extended or adjusted under 35 U.S.C. 154(b) by 0 days.

(21) Appl. No.: 13/879,586

(22) PCT Filed: Oct. 14, 2011

(86) PCT No.: PCT/NL2011/050703
§ 371 (c)(1),
(2), (4) Date: Aug. 13, 2013

(87) PCT Pub. No.: WO2012/067500
PCT Pub. Date: May 24, 2012

(65) Prior Publication Data

US 2014/0147218 A1 May 29, 2014

(30) Foreign Application Priority Data

Oct. 15, 2010 (NL) ..... 1038310

(51) Int. Cl.
*E02B 3/12* (2006.01)
*E02D 17/20* (2006.01)

(52) U.S. Cl.
CPC ..... *E02B 3/122* (2013.01); *E02D 17/20* (2013.01); *E02D 17/202* (2013.01)

(58) Field of Classification Search
USPC ..... 405/302.4, 302.6, 302.7, 15, 16, 19; 428/117, 130
See application file for complete search history.

(56) References Cited

U.S. PATENT DOCUMENTS

| | | | | |
|---|---|---|---|---|
| 3,649,403 | A * | 3/1972 | Tisdale | 156/197 |
| 4,804,293 | A * | 2/1989 | Varkonyi et al. | 405/15 |
| 5,039,250 | A | 8/1991 | Janz | |
| 5,449,543 | A | 9/1995 | Bach et al. | |
| 5,580,190 | A | 12/1996 | Yang et al. | |
| 6,296,924 | B1 | 10/2001 | Bach | |
| 8,864,424 | B2 * | 10/2014 | Jones et al. | 405/302.7 |
| 2006/0147275 | A1 * | 7/2006 | Lin et al. | 405/302.4 |

(Continued)

FOREIGN PATENT DOCUMENTS

| | | |
|---|---|---|
| GB | 2185769 | 7/1987 |
| GB | 2185769 A | 7/1987 |

(Continued)

*Primary Examiner* — Sean D Andrish
(74) *Attorney, Agent, or Firm* — NLO N.V.; Catherine Shultz; Tamara Stegmann

(57) ABSTRACT

Method for forming a ground-covering layer (1), comprising the steps of providing a sheet (2); forming a number of substantially parallel folds (3) in the sheet; and urging toward each other and connecting to each other adjacent folds at different locations wherein the connections of each fold to an adjacent fold on the one side are offset relative to the connections to an adjacent fold on the other side. Ground-covering layer (1), comprising a sheet (2) with a number of substantially parallel folds (3), which folds are connected at different locations to adjacent folds, wherein the connections of each fold to an adjacent fold on the one side are offset relative to the connections to an adjacent fold on the other side.

20 Claims, 4 Drawing Sheets

(56) References Cited

U.S. PATENT DOCUMENTS

| | | | | |
|---|---|---|---|---|
| 2010/0167007 | A1* | 7/2010 | Goering | 428/124 |
| 2010/0254795 | A1 | 10/2010 | Halahmi | |

FOREIGN PATENT DOCUMENTS

| | | | | |
|---|---|---|---|---|
| JP | 02091302 | A | | 3/1990 |
| JP | 02167747 | A | | 6/1990 |
| JP | 02261104 | A | | 10/1990 |
| WO | 9535417 | A1 | | 12/1995 |
| WO | WO199535417 | | | 12/1995 |
| WO | WO2008/037972 | | * | 9/2007 |
| WO | 2011125044 | A2 | | 10/2011 |

* cited by examiner

METHOD FOR FORMING A GROUND-COVERING LAYER, AND THUS FORMED GROUND-COVERING LAYER

INTRODUCTION

Field of the Invention

The invention relates to a method for forming a ground-covering layer. Such a layer can for instance be used to stabilize or protect a ground against erosion.

Background of the Invention

Already known from the British patent 2.185.769 is a method for forming a ground-covering layer wherein a grid of geotextile is formed. This grid is formed by laying onto each other and connecting to each other a number of strips of a geotextile material, wherein a strip is connected in each case to two adjacent strips at mutually offset locations. When the thus formed package of mutually connected strips is then placed on its edge and pulled apart, a grid is created which defines a number of spaces bounded by the strips. This grid can be placed on a ground surface and the spaces can then be filled, for instance with sand, earth or rubble. The known ground-covering layer is used for instance to stabilize sloping ground surfaces, such as dike bodies. In a variant of the method according to this British patent the grid is glued to a base of geotextile after being folded out, wherein the other side of the base can then be further covered with a water-impermeable layer of plastic. A water-tight stabilizing layer is thus obtained.

The known method has the drawback of being relatively complicated and requiring quite a large number of operations. This is particularly the case when it is the desire to obtain a grid closed on the underside.

SUMMARY

The invention therefore has for its object to provide a method of the above described type wherein these drawbacks do not occur, or at least do so to lesser extent. According to the invention this is achieved with a method comprising the steps of:

providing a sheet;

forming a number of substantially parallel folds in the sheet; and urging toward each other and connecting to each other adjacent folds at different locations, wherein the connections of each fold to an adjacent fold on the one side are offset relative to the connections to an adjacent fold on the other side.

By making use of a sheet in which folds can be formed a grid can be formed in much simpler manner than if use is made of separate strips. The spaces formed between the folds are moreover directly closed on the underside by the sheet. A separate groundsheet need not therefore be connected to the grid.

The method preferably further comprises the step of at least partially filling spaces formed between the mutually connected folds with a functional material. This functional material can be a weighting material, such as sand, earth or gravel, but could for instance also be a granular, damping or resilient material such as rubber, polystyrene and the like. The ground-covering layer can thus be readily adapted to the purpose for which it is used.

The connections can be formed in simple manner by glueing the folds locally to each other. It is on the other hand also possible to form the connections by stitching the folds locally to each other. When the sheet is manufactured at least partially from plastic, the connections can also be formed by welding the folds locally to each other, for instance by ultrasonic welding.

Although the connections are a significant factor in stabilizing the ground-covering layer, it may be advantageous to form these connections over only a part of the height of the folds. The part of the folds above the connections can then be used for other functions.

The method can for instance further comprise the step of cutting through at least some of the folds above the connections. Separate upright parts are thus formed.

If the sheet is woven and a density is chosen at the position of at least some of the folds which is lower than between the folds, after being cut through the upright parts can form loose fibres which can for instance serve as artificial grass blades. This can be achieved by arranging fewer warp or weft threads (depending on the orientation of the folds) in the woven material at the position of the folds.

Conversely, it is possible for a second sheet to be laid over the spaces and connected to the severed parts of the folds. A larger area of contact is formed with the sheet lying above by using the severed parts, whereby a strong connection can be effected. The sheet with the folds and the second sheet lying thereabove thus form a closed construction, the spaces of which can be filled with a functional material. This functional material can for instance be a damping material, such as plastic granules, whereby a damping mat is obtained.

With a view to obtaining a stable grid, it can be advantageous for the sheet to be strengthened at the position of at least some of the folds. In the case of a woven sheet this can be achieved in simple manner by locally co-weaving relatively stronger or stiffer warp or weft threads. A non-woven can be strengthened by arranging strengthening threads or strips locally thereon.

The sheet can be manufactured at least partially from natural material. This reduces the environmental impact and the ground-covering layer can be easily recycled after use.

The sheet between the folds can advantageously be manufactured at least partially from biodegradable material. Due to the decomposition of this biodegradable material between the folds openings are thus formed in the sheet after a period of time through which for instance vegetation can grow. The ground-covering layer is thus further secured to the underlying ground by the vegetation, and a natural whole is eventually obtained.

The invention further relates to a ground-covering layer which can be obtained by applying the above described method. Such a layer comprises according to the invention a sheet with a number of substantially parallel folds, which folds are connected at different locations to adjacent folds, wherein the connections of each fold to an adjacent fold on the one side are offset relative to the connections to an adjacent fold on the other side.

Preferred embodiments of the ground-covering layer according to the invention form the subject matter of the sub-claims 13 to 22.

The invention is now elucidated on the basis of a number of embodiments, wherein reference is made to the accompanying drawing in which corresponding components are designated with the same reference numerals, and in which:

BRIEF DESCRIPTION OF THE FIGURES

FIGS. 1 to 5 schematically show the different steps of the method for forming a ground-covering layer according to the invention, wherein FIGS. 4 and 5 show a greater part of the layer including more folds than FIGS. 1 to 3.

DETAILED DESCRIPTION

Figure 1:
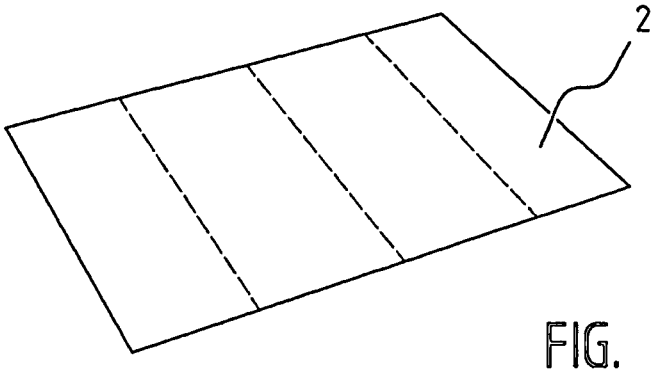
Figure 2:
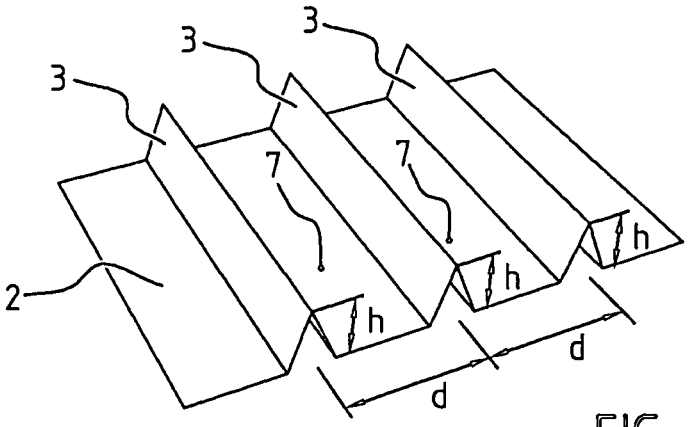
Figure 3:
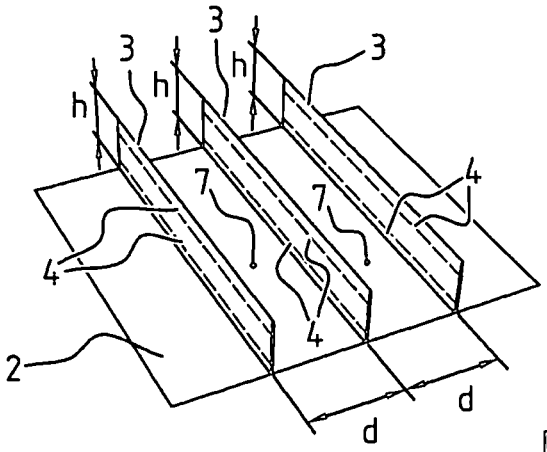

In the method for forming a ground-covering layer 1 according to the invention use is made of a sheet 2 (FIG. 1). This sheet 2 can be a woven material, but also a non-woven, and can for instance be a length with a standard width of 4 m as frequently used in the carpet and artificial grass industry. Formed in sheet 2 are a number of parallel folds 3 of substantially equal height h and at a substantially equal intermediate distance d (FIG. 2). Folds 3 can for instance be formed by guiding the sheet over suitable pleating or folding rollers. Folds 3 are then fixed by for instance being connected to each other at two different levels in longitudinal direction (FIG. 3) with the forming of longitudinal connections or seams 4. Depending on the nature of the material used, folds 3 can be connected by glueing, welding (thermal or ultrasonic), stitching or any other suitable connecting technique.

Figure 4:
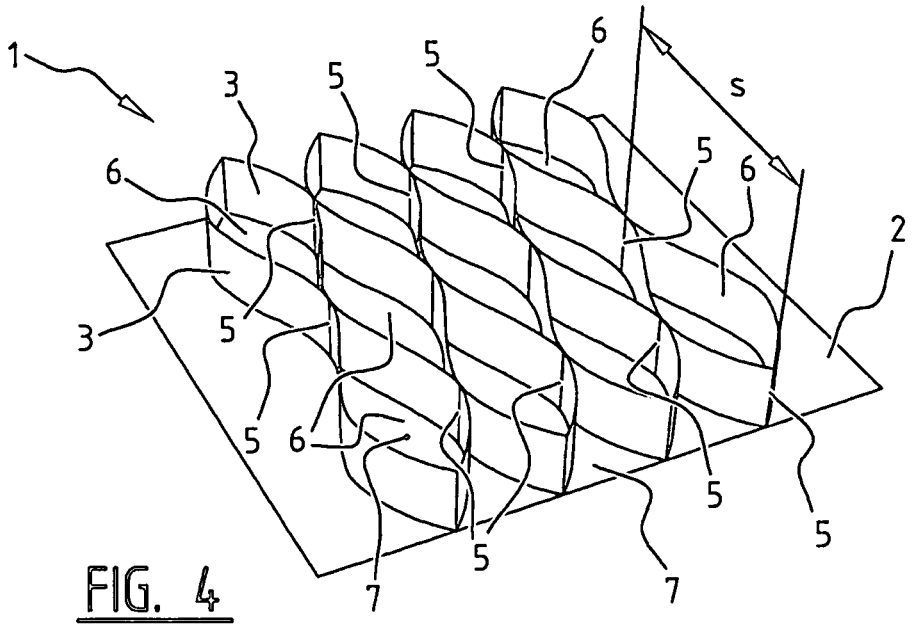
Figure 5:
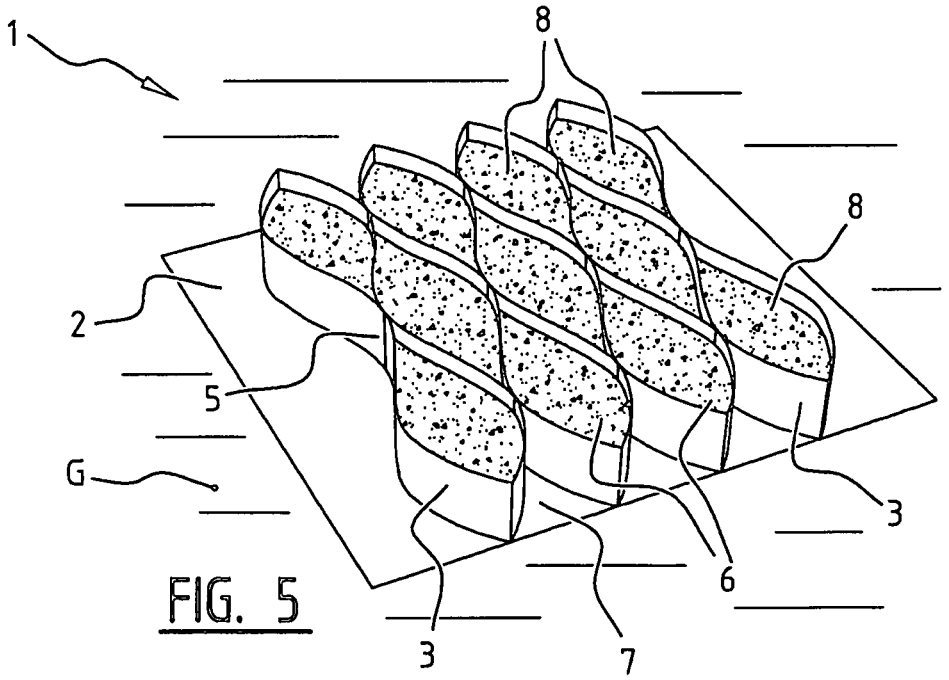
Figure 9:
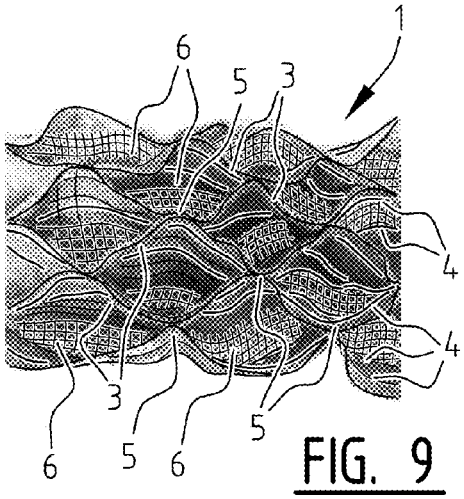
FIG. 9 is a top view of an alternative embodiment of the ground-covering layer manufactured from a natural material and formed with stitching.

The height h and intermediate distance d of folds 3 are adapted to each other such that they can be urged toward and connected to each other locally without too much difficulty (FIG. 4). The connections of each fold to an adjacent fold on the one side are here offset relative to the connections to an adjacent fold on the other side, so that a grid is formed. For the purpose of forming the local connections 5 use is once again made of techniques such as glueing, welding or stitching, this time in height direction. The pitch s between the corresponding connections 5 determines together with the intermediate distance d the final form of the grid formed by folds 3 and of the spaces 6 between the folds 3 connected locally to each other. The sheet 7 between folds 3 forms a base for spaces 6. It should be noted that the sheet 7 does not retain its planar configuration when the folds are urged together. FIGS. 4 and 5 are schematic in this respect. The actual configuration of the layer 1 after locally connecting the folds 3 is shown in FIG. 9. When layer 1 has been thus formed, it can be laid on a ground surface G, after which spaces 6 can be filled with a stabilizing or weighting material 8 such as sand, earth or rubble or the like (FIG. 5).

In the shown embodiment sheet 2 is a uniform woven material or a non-woven. It is however also possible to envisage sheet 2 being strengthened at the position of folds 3, for instance by using stronger or stiffer warp or weft threads there (depending on the direction of folds 3 in the woven material).

Figure 6:
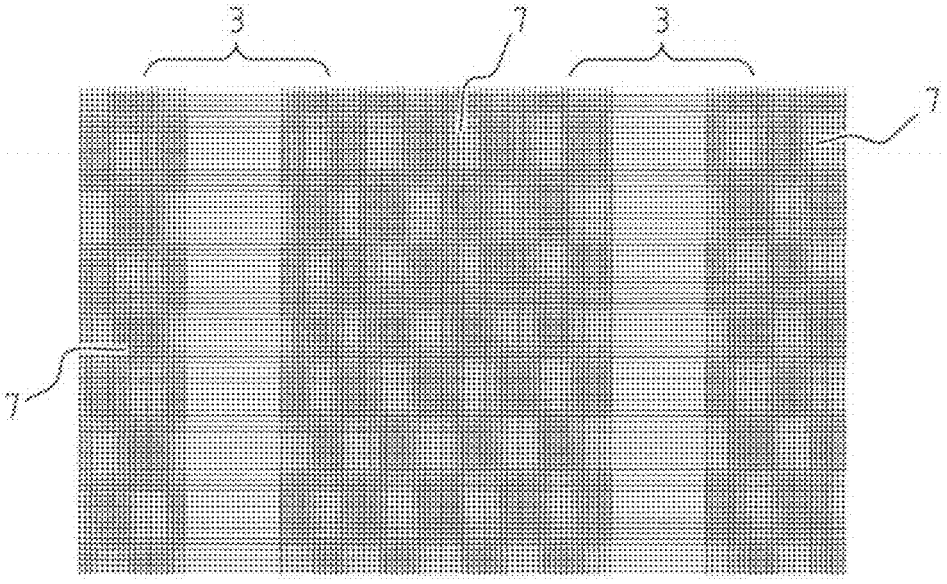
FIG. 6 is a top view of a woven material with locally reduced density.
Figure 7:
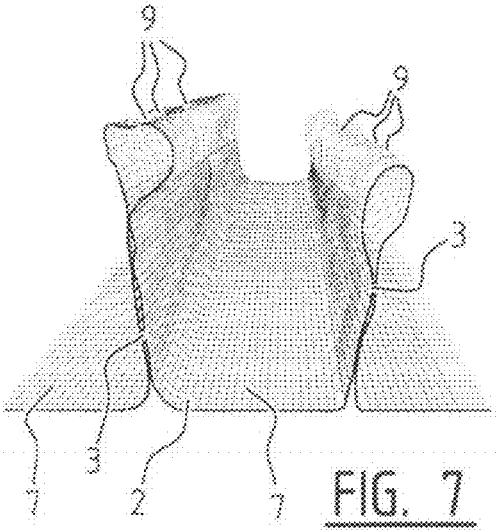
FIG. 7 and FIG. 8 are perspective views of the woven material of FIG. 6 after folds have been formed therein and these folds have been cut open.
Figure 8:
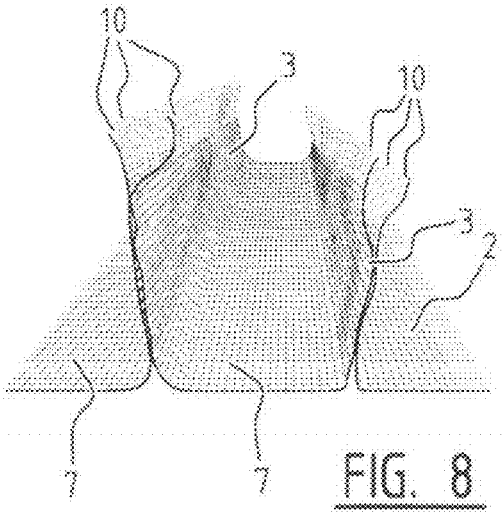

Conversely, it is also possible to give the woven material a less dense form, precisely at the position of folds 3, by omitting warp or weft threads there (FIG. 6). After forming and fixing of the folds the remaining weft or warp threads then form pile threads 9 there (FIG. 7), which can be cut through to form blades 10. Folds 3 of sheet 2 can be pulled for this purpose over a set of knives. Folds 3 can then be urged toward each other again locally and connected to each other in order to forma grid. Connections 5 then of course extend only over the part of folds 3 lying under the blades. When the woven material is made of green thread, ground-covering layer 1 in this way acquires the appearance of an (artificial) grass field. When layer 1 is applied as stabilizing layer on a loose ground, for instance as verge adjacently of a road, this results in a more natural appearance. If however spaces 6 are filled with a mixture of sand and rubber granules, the ground-covering layer could even be used as artificial grass field for sport or games.

The omission of warp or weft threads at the position of folds 3 is not only important for the purpose of forming blades but also in respect of the draining properties of layer 1. This is because folds 3 hereby become porous on the upper side so that water can sink through folds 3 and can thus be discharged.

Sheet 2 can be made of plastic, although the use of natural materials, such as jute, can also be envisaged (FIG. 9). In this case the connections are formed by stitching with a thread of natural material. This applies for both the longitudinal connections 4 for fixation of folds 3 and connections 5 in height direction for the purpose of forming the grid.

Figure 10:
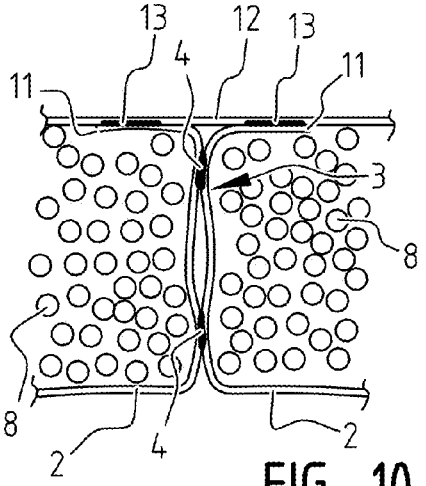
FIG. 10 is a side view of yet another embodiment of the ground-covering layer, wherein the spaces between the folds are closed by a second sheet.

In yet another embodiment of ground-covering layer 1 according to the invention the folds 3 are likewise cut open after fixing thereof, but are not used as upright blades for embellishing the appearance of layer 1. The cut-open upper ends 11 of folds 3, after the spaces 6 therebetween have been filled with a functional material 8, are instead folded over the filling (FIG. 10). A second sheet 12 is then laid over the thus formed ground-covering layer 1 and attached thereto by being welded or glued to the folded upper ends 11 of folds 3. A layer is thus created with a large number of chambers closed on all sides and bounded by folds 3, the sheet 7 therebetween functioning as base, and the second sheet 12. The surface available for the weld or glue connections 13 is considerably enlarged by folding the ends 11 of folds 3 away from each other. A granular plastic such as polystyrene granules can for instance be used in this case as filler material 8. Ground-covering layer 1 can then be applied as damping layer, for instance under a sports field or playing field.

Figure 11:
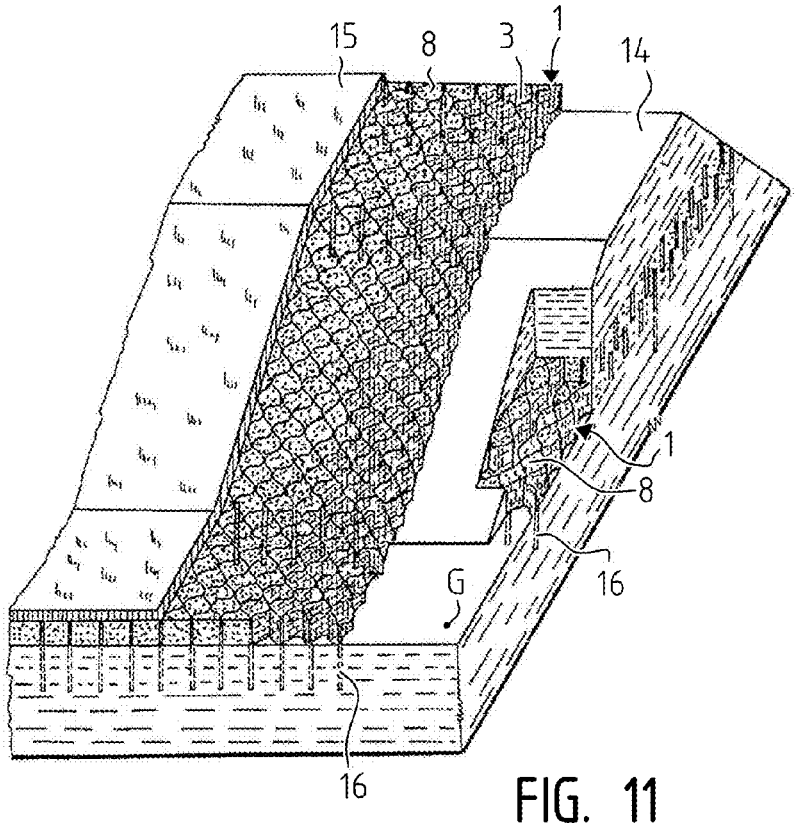
FIG. 11 is a perspective view of the ground-covering layer in use on a ground surface.

As stated, layer 1 can be laid on a ground surface G and then filled with a weighting stabilizing material 8. This filler material 8 can form part of a dike body 14 formed on layer 1 (FIG. 11) or of a landscaped top layer 15 arranged over ground-covering layer 1. This figure otherwise further shows how ground-covering layer 1 can be fixed to ground surface G by means of pins 16.

Instead of arranging a layer of vegetation over ground-covering layer 1, it is also possible to opt to allow vegetation to grow on layer 1. Biodegradable materials can for this purpose be incorporated in sheet 2, particularly the part 7 between folds 3. When these materials, for instance warp and/or weft threads in the case of a woven material, decompose, openings are created in layer 1 through which plants or grass can grow.

The invention thus provides the option of forming in simple manner in a production line a grid with base which can be used as ground-covering layer. This layer can function as stabilizing layer and can counter erosion of the ground surface. The layer can also be used as playing or sports field, while with a suitable choice of the filler material an application as damping substrate for playing or sports fields can also be envisaged. When the layer is formed from a woven material, the properties of the layer can be varied locally through a suitable choice of warp and/or weft threads. The strength and stiffness of the grid can thus be increased, while in addition the water drainage through the folds—the walls of the grid—can for instance be enhanced. Plants or grass can eventually grow on the layer by embodying apart of the layer in biodegradable material. Although the invention is described above on the basis of a number of embodiments, it will be apparent that it is not limited thereto. The invention can be varied in many ways within the scope of the following claims.

The invention claimed is:

1. A playing field comprising:

a ground covering layer comprising a horizontal textile sheet with a number of folds extending upwards in a height direction to form walls of chambers, which folds are initially formed as substantially parallel folds and are connected at different locations to adjacent folds, wherein the connections of each fold to an adjacent fold on the one side are offset relative to the connections to an adjacent fold on the other side, so as to form a grid of the chambers closed on the underside with a base formed of the sheet in between adjacent folds, and filler material to fill each chamber; and a landscaped top layer comprising a playing surface over the ground covering layer.

2. The playing field of claim 1, wherein the filler comprises a functional material.

3. The playing field of claim 1, wherein the adjacent folds are glued to each other locally.

4. The playing field of claim 1, wherein the adjacent folds are stitched to each other locally.

5. The playing field of claim 1, wherein the textile sheet is manufactured at least partially from plastic and the adjacent folds are welded to each other locally.

6. The playing field of claim 1, wherein the adjacent folds are connected to each other over only a part of their height.

7. The playing field of claim 1, wherein at least some of the folds are cut through above the connections.

8. The playing field of claim 7, wherein the textile sheet is woven and the woven material at a position of at least some of the folds has a lower density than between adjacent folds.

9. The playing field of claim 1, further comprising a second sheet laid over the chambers to form closed chambers.

10. The playing field of claim 9, wherein the second sheet is connected to the textile sheet.

11. The playing field of claim 1, wherein the textile sheet is strengthened at a position of at least some of the folds.

12. The playing field of claim 1, wherein the textile sheet between the folds is manufactured at least partially from biodegradable material.

13. A ground covering comprising:

a ground covering layer comprising a horizontal textile sheet with a plurality of adjacent folds extending upwards in a height direction to form walls of chambers, which folds are initially formed as substantially parallel folds and are connected at different locations to adjacent folds, wherein the connections of each fold to an adjacent fold on one side are offset relative to the connections to an adjacent fold on an other side so as to form a grid of the chambers closed on an underside with a base formed of the sheet in between adjacent folds, and filler material to fill each chamber; and a landscaped top layer arranged over the ground covering layer.

14. The ground covering of claim 13, wherein the adjacent folds are glued or stitched to each other locally.

15. The ground covering of claim 13, wherein the textile sheet is manufactured at least partially from plastic and the adjacent folds are welded to each other locally.

16. The ground covering of claim 13, wherein the adjacent folds are connected to each other over only a part of their height.

17. The ground covering of claim 13, wherein at least some of the folds are cut through above the connections.

18. The ground covering of claim 13, wherein the textile sheet is strengthened at a position of at least some of the folds.

19. The ground covering of claim 13, wherein the textile sheet is manufactured at least partially from natural armor biodegradable material.

20. The ground covering of claim 13, wherein no stakes or pins are used in the ground covering.

* * * * *